US007938499B2

(12) United States Patent
Matsumoto et al.

(10) Patent No.: US 7,938,499 B2
(45) Date of Patent: May 10, 2011

(54) LIQUID DISCHARGE DEVICE, PIEZOELECTRIC INK JET HEAD, AND DRIVING METHOD FOR LIQUID DISCHARGE DEVICE

(75) Inventors: Ayumu Matsumoto, Kirishima (JP); Naoto Iwao, Nagoya (JP)

(73) Assignees: Kyocera Corporation, Kyoto (JP); Brother Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 12/092,260

(22) PCT Filed: Sep. 29, 2006

(86) PCT No.: PCT/JP2006/319547

§ 371 (c)(1),
(2), (4) Date: May 7, 2009

(87) PCT Pub. No.: WO2007/052434

PCT Pub. Date: May 10, 2007

(65) Prior Publication Data

US 2009/0219315 A1 Sep. 3, 2009

(30) Foreign Application Priority Data

Oct. 31, 2005 (JP) ..... 2005-316984

(51) Int. Cl.
*B41J 29/38* (2006.01)

(52) U.S. Cl. ..... 347/14; 347/57

(58) Field of Classification Search ..... 347/10–11, 347/14, 57, 68, 70

See application file for complete search history.

(56) References Cited

U.S. PATENT DOCUMENTS

| | | | | |
|---|---|---|---|---|
| 6,174,038 | B1 | 1/2001 | Nakazawa et al. | |
| 6,386,664 | B1 * | 5/2002 | Hosono et al. | 347/9 |
| 6,945,627 | B2 | 9/2005 | Yamaguchi | |
| 7,055,922 | B2 | 6/2006 | Ikeda et al. | |
| 7,073,885 | B2 | 7/2006 | Yonekubo et al. | |
| 7,195,327 | B2 | 3/2007 | Kitami et al. | |
| 2004/0001123 | A1 | 1/2004 | Yamaguchi | |

(Continued)

FOREIGN PATENT DOCUMENTS

JP 55-090373 7/1980

(Continued)

OTHER PUBLICATIONS

European search report for corresponding European application 06810926.3 lists the references above.

(Continued)

*Primary Examiner* — Thinh H Nguyen
(74) *Attorney, Agent, or Firm* — DLA Piper LLP (US)

(57) ABSTRACT

It is possible to minimize the amplitude of residual vibration of a piezoelectric actuator so as to maintain the image quality of a formed image at a preferable level in case of an ink jet head, for example. A liquid discharge device includes a control unit (14) for ON/OFF control of a drive voltage applied to the piezoelectric actuator. The control unit (14) has a micro vibration control section (23) for drive-controlling a drive circuit so as to micro-vibrate the piezoelectric actuator in a waiting state not discharging a liquid drop from a nozzle, in a range that no liquid drop is discharged in the nozzle. The piezoelectric ink jet head includes the liquid discharge device. The drive method is for micro-vibrating the piezoelectric actuator in the waiting state not discharging a liquid drop from the nozzle, in a range that no liquid drop is discharged from the nozzle.

14 Claims, 11 Drawing Sheets

U.S. PATENT DOCUMENTS

| | | | |
|---|---|---|---|
| 2004/0155915 | A1 | 8/2004 | Kitami et al. |
| 2004/0165020 | A1 | 8/2004 | Yonekubo et al. |
| 2005/0052492 | A1 | 3/2005 | Ikeda et al. |

FOREIGN PATENT DOCUMENTS

| | | | |
|---|---|---|---|
| JP | 59114064 | A | 6/1984 |
| JP | 02-192947 | | 7/1990 |
| JP | 2004-090542 | | 3/2004 |
| JP | 2004082718 | A | 3/2004 |
| JP | 2004160903 | A | 6/2004 |

OTHER PUBLICATIONS

Chinese language office action dated May 19, 2010 and its English language translation for corresponding Chinese application No. 200680040519.6 lists the references above.

* cited by examiner

LIQUID DISCHARGE DEVICE, PIEZOELECTRIC INK JET HEAD, AND DRIVING METHOD FOR LIQUID DISCHARGE DEVICE

TECHNICAL FIELD

The present invention relates to a liquid discharge device that can be employed as a piezoelectric ink jet head or the like, a piezoelectric ink jet head using the liquid discharge device, and a driving method for a liquid discharge device.

BACKGROUND ART

FIG. 1 is a sectional view showing an example of a liquid discharge device 1 serving as a piezoelectric ink jet head used for an on-demand type ink jet printer or the like. FIG. 2 is a partially enlarged sectional view of a piezoelectric actuator 7 of the liquid discharge device 1 shown in FIG. 1. Referring to FIGS. 1 and 2, the liquid discharge device 1 in this example includes a substrate 5 having a plurality of liquid drop discharge sections 4 arranged therein in a planar direction, each of the liquid drop discharge sections 4 having a pressure chamber 2 to be filled with ink and a nozzle 3 communicating with the pressure chamber 2 for discharging the ink within the pressure chamber 2 as an ink drop, and a plate-shaped piezoelectric actuator 7 including a piezoelectric ceramic layer 6 having a dimension covering the plurality of pressure chambers 2 in the substrate 5 and laminated on the substrate 5.

The piezoelectric actuator 7 is partitioned into a plurality of piezoelectric deformation regions 8 respectively disposed so as to correspond to the pressure chambers 2 and individually deflected and deformed in the thickness direction by individual application of drive voltages, and a binding region 9 disposed so as to surround the piezoelectric deformation regions 8 and prevented from being deformed by being fixed to the substrate 5. Furthermore, the piezoelectric actuator 7 in the illustrated example has a so-called unimorph type configuration including discrete electrodes 10 respectively formed for the pressure chambers 2 on an upper surface of the piezoelectric ceramic layer 6 in both the drawings for defining the piezoelectric deformation regions 8, and a common electrode 11 and a vibrating plate 12 laminated in this order on a lower surface of the piezoelectric ceramic layer 6 and both having dimensions covering the plurality of pressure chambers 2. Each of the discrete electrodes 10 and the common electrode 11 are individually connected to a drive circuit 13, and the drive circuit 13 is connected to a control unit 14.

The piezoelectric ceramic layer 6 is formed of a piezoelectric material such as PZT, and is given piezoelectric deformation characteristics in a so-called transverse vibration mode by being previously polarized in the thickness direction of the layer. When a drive voltage in the same direction as the direction of the polarization is applied from the drive circuit 13 to an area between the discrete electrode 10 that define any one of the piezoelectric deformation regions 8 and the common electrode 11, an active region 15, which corresponds to the piezoelectric deformation region 8 and is sandwiched between both the electrodes 10 and 11, contracts in the planar direction of the layer, as indicated by transverse white arrows in FIG. 2. However, the lower surface of the piezoelectric ceramic layer 6 is fixed to the vibrating plate 12 through the common electrode 11. When the active region 15 contracts, therefore, the piezoelectric deformation region 8 in the piezoelectric actuator 7 is accordingly deflected and deformed so as to project toward the pressure chamber 2, as indicated by a downward white arrow in FIG. 2. When the piezoelectric deformation region 8 is vibrated by combining a state where the piezoelectric deformation region 8 is deflected and deformed and a state where the application of the drive voltage is stopped to release the deflection and deformation, the ink filled in the pressure chamber 2 is pressurized by the vibration and is discharged as an ink drop through the nozzle 3.

In the liquid discharge device, a so-called Pull-push driving method is generally employed widely, as disclosed in Patent Document 1. FIG. 3 is a graph showing a relationship between an example of a drive voltage waveform (indicated by a thick one-dot and dash line) generated by ON/OFF control of a drive voltage $V_P$ applied to the piezoelectric actuator 7 from the drive circuit 13 when the liquid discharge device 1 shown in FIG. 1 is driven by the normal Pull-push driving method, and a change in volume velocity of ink [indicated by a thick solid line, where (+) is on the side of the tip of the nozzle 3, that is, on the side of discharge of an ink drop, and (−) is on the side of the pressure chamber 2] within the nozzle 3 occurring when the drive voltage waveform is applied.

Referring to FIGS. 1 to 3, in a waiting time period during which no ink drop is discharged from the nozzle 3 on the left of $t_1$ in FIG. 3, the drive voltage $V_P$ is maintained at ON satate, that is, at $V_H$ ($V_P$=$V_H$), to cause the active region 15 to continues to contract in the planar direction, to maintain a state where the piezoelectric deformation region 8 is deflected and deformed so as to project toward the pressure chamber 2, thereby to decrease the volume of the pressure chamber 2. During this period, the ink is in a stationary state, that is, the volume velocity of the ink in the nozzle 3 is maintained at zero, so that an ink meniscus formed by the surface tension of the ink remains stationary within the nozzle 3.

In order to discharge the ink drop from the nozzle 3 to form a dot on a paper surface, the drive voltage $V_P$ is turned off, that is, electrically discharged ($V_P$=0V), at the time point of $t_1$ immediately before that to release the contraction in the planar direction of the active region 15, to release the deflection and deformation of the piezoelectric deformation region 8. Thus, the volume of the pressure chamber 2 is increased by a predetermined amount. Therefore, the ink meniscus within the nozzle 3 is pulled toward the pressure chamber 2 by the amount of increase in the volume. The volume velocity of the ink within the nozzle 3 at this time gradually decreases after increasing once toward the (−) side, to come closer to zero in time, as shown in a portion between $t_1$ and $t_2$ in FIG. 3. This corresponds to a period that is substantially one-half an intrinsic vibration period $T_1$ of intrinsic vibration of the volume velocity of the ink, indicated by the thick solid line.

Then, at the time point of $t_2$ where the volume velocity of the ink in the nozzle 3 comes as close to zero as possible, the drive voltage $V_P$ is turned on, that is, electrically charged to $V_H$ ($V_P$=$V_H$) again to cause the active region 15 to contract in the planar direction, to deflect and deform the piezoelectric deformation region 8. As a result, the ink within the nozzle 3 is accelerated toward the tip of the nozzle 3 to project greatly outward from the nozzle 3 because the pressure of the ink pushed out of the pressure chamber 2 by deflecting and deforming the piezoelectric deformation region 8 to decrease the volume of the pressure chamber 2 is applied when the ink meniscus attempts to return to the tip of the nozzle 3 conversely from a state where it is pulled most greatly toward the pressure chamber 2 (a state where the volume velocity is zero at the time point of $t_2$). At this time, the volume velocity of the ink within the nozzle 3 gradually decreases after increasing once toward the (+) side, to come closer to zero in time, as shown in a portion between $t_2$ and $t_3$ in FIG. 3. The ink that has projected outward from the nozzle 3 looks substantially columnar. Therefore, the ink in the projecting state is generally referred to as an ink column.

After a time point where the volume velocity of the ink in the nozzle 3 reaches zero (a time point of $t_3$ in FIG. 3), the vibration velocity of the ink is directed to the pressure chamber 2, so that the ink column that has completely extended outward from the nozzle 3 is separated, to form an ink drop. The formed ink drop flies to a paper surface disposed so as to be opposed to the tip of the nozzle 3, to form a dot on the paper surface. The above-mentioned series of operations corresponds to application, to the piezoelectric deformation region 8, of the drive voltage $V_P$ having a drive voltage waveform including one pulse whose pulse width $T_2$ is approximately one-half the intrinsic vibration period $T_1$, as indicated by the thick one-dot and dash line in FIG. 3. When one dot is formed by two or more ink drops, the pulses described above, whose number corresponds to the number of ink drops, may be continuously generated.

Patent Document 1: Japanese Unexamined Patent Publication No. 02-192947 (Page 3 upper left column line 19 to page 3 upper right column line 6, page 3 upper right column line 14 to page 3 lower left column line 2, and FIG. 16(*b*)).

DISCLOSURE OF THE INVENTION

Problems to be Solved by the Invention

In the liquid discharge device, the piezoelectric deformation region 8 in the piezoelectric actuator 7 may vibrate in a small period that is a fraction of several tenths to one severalth of the pulse width $T_2$ of the drive voltage waveform at the time of driving, that is, residual vibration may be generated. The residual vibration is overlapped with the vibration of the volume velocity of the ink shown in FIG. 3 at the time when the ink drop is discharged. When the amplitude of the residual vibration is large, therefore, it affects the volume velocity of the ink, to degrade the image quality of a formed image.

For example, the ink meniscus before discharge of the ink drop must be inherently stabilized in a stationary state, as previously described. When the amplitude of the residual vibration is large, however, the ink meniscus vibrates and does not remain stationary. Therefore, the size and the shape of the ink drop discharged from the nozzle 3 through the above-mentioned series of sections 4 or for each operation in each of the liquid drop discharge sections 4 depending on the position and the speed of the ink meniscus at the start of the operation. Therefore, the size of the dot formed on the paper surface varies, so that the image quality of the formed image is degraded. When the size of the ink drop varies for each operation, for example, a shading strip pattern conforming to the variation in the size of the ink drop occurs in the formed image.

When the amplitude of the residual vibration is large, conditions where the ink column is separated to form the ink drop (the position and the speed at which the ink column is separated) vary. As a result, the flying direction of the formed ink drop is bent, or a fine ink drop called mist that is less than the ink drop for forming the dot is generated in large amounts.

When the flying direction of the ink drop is bent, the position of the dot formed on the paper surface is shifted, or the shape of the dot is deformed from a circular shape that is ideal. When a large amount of mist is generated, the mist adheres to the periphery of the dot on the paper surface, resulting in defective images called scatter. Therefore, the image quality of the formed image is degraded in either one of the above-mentioned cases.

An object of the present invention is to provide a liquid discharge device capable of minimizing the amplitude of residual vibration of a piezoelectric actuator to maintain the image quality of a formed image at a preferable level in the case of a piezoelectric ink jet head, for example, a piezoelectric ink jet head using the liquid discharge device, and a driving method for a liquid discharge device in which the amplitude of the residual vibration can be minimized.

Means for Solving the Problems

In order to attain the above-mentioned object, a liquid discharge device of the present invention includes (A) a pressure chamber to be filled with a liquid, (B) a nozzle communicating with the pressure chamber, (C) a piezoelectric actuator vibrated by application of a drive voltage and the ON/OFF control of the drive voltage for discharging the liquid within the pressure chamber through the nozzle as a liquid drop, (D) a drive circuit for applying the drive voltage to the piezoelectric actuator, and (E) a control unit for carrying out the ON/OFF control of the drive voltage, in which the control unit includes a micro vibration control section for controlling the driving of the drive circuit in order to micro-vibrate the piezoelectric actuator in a range in which no liquid drop is discharged from the nozzle in a waiting time period during which no liquid drop is discharged from the nozzle.

In the liquid discharge device according to the present invention, the residual vibration of the piezoelectric actuator can be forcibly caused to coincide with the micro vibration by micro-vibrating the piezoelectric actuator in a range in which no liquid drop is discharged from the nozzle in a waiting time period during which no liquid drop is discharged from the nozzle by the function of the micro vibration control section included in the control unit. Therefore, the liquid discharge device according to the present invention allows the image quality of a formed image to be always maintained at a preferable level, for example, in the case of a piezoelectric ink jet head by minimizing the amplitude of the micro vibration to a range in which the previously described various influence are not exerted thereon, to suppress the amplitude of the residual vibration in the above-mentioned range.

In the liquid discharge device according to the present invention, it is preferable that the control unit turns the drive voltage off from a waiting state in which the drive voltage is on, and then turns the drive voltage on again to vibrate the piezoelectric actuator, thereby to discharge the liquid within the pressure chamber as the liquid drop through the nozzle, and that the micro vibration control section periodically repeats the fall and the rise of the drive voltage in a range, in which the drive voltage is not turned off, immediately after the drive voltage is turned on again, to micro-vibrate the piezoelectric actuator. In such a configuration, in the Pull-push driving method, the residual vibration of the piezoelectric actuator at the time point where an ink column is separated to form an ink drop after the drive voltage is turned on again can be forcibly caused to coincide with the micro vibration. Therefore, it is possible to prevent the flying direction of the ink drop from being bent and prevent mist from being generated by always keeping constant conditions where the ink column is separated to form the ink drop (the position and the direction in which the ink column is separated). Therefore, the image quality of the formed image can be always maintained at a preferable level.

It is preferable that the control unit turns the drive voltage off from a waiting state in which the drive voltage is on, and then turns the drive voltage on again to vibrate the piezoelectric actuator, thereby to discharge the liquid within the pressure chamber as the liquid drop through the nozzle, and that the micro vibration control section periodically repeats the fall and the rise of the drive voltage in a range, in which the drive voltage is not turned off, immediately before the drive voltage is turned off, to micro-vibrate the piezoelectric actuator. In such a configuration, the residual vibration of the piezoelectric actuator at a time point immediately before the discharge of the ink drop by the Pull-push driving method can be forcibly caused to coincide with the micro vibration, thereby to stabilize an ink meniscus in a stationary state. Since the size and the shape of the ink drop discharged from the nozzle through a series of processes can be made constant for each of the liquid drop discharge sections or for each operation in each of the liquid drop discharge sections. Therefore, the image quality of a formed image can be always maintained at a preferable level by preventing the size of a dot formed on a paper surface from varying.

In the liquid discharge device according to the present invention, it is preferable that the control unit turns the drive voltage off from a waiting state in which the drive voltage is on, and then turns the drive voltage on again to vibrate the piezoelectric actuator, thereby to discharge the liquid within the pressure chamber as the liquid drop through the nozzle, and that the micro vibration control section repeats an operation of lowering the drive voltage, and raising the drive voltage in a range in which the drive voltage is not turned off while falling, thereby to micro-vibrate the piezoelectric actuator, on the basis of a time constant of voltage fall at the time when the drive voltage is turned off and a time constant of voltage rise at the time when the drive voltage is turned on, which are previously set in the drive circuit, in order to carry out ON/OFF control of the drive voltage to discharge the liquid drop.

In such a configuration, a special circuit for the micro vibration is not required, and only a circuit for carrying out the Pull-push driving method allows the piezoelectric actuator to be micro-vibrated. Therefore, the configuration of the device can be simplified.

It is preferable that the micro vibration control section micro-vibrates the piezoelectric actuator by a displacement amount that is 5 to 50% of the displacement amount of the piezoelectric actuator when ON/OFF control of the drive voltage is carried out to discharge the liquid drop. When the displacement amount of the micro vibration of the piezoelectric actuator is less than the above-mentioned range, the effect of micro-vibrating the piezoelectric actuator to forcibly cause the residual vibration to coincide with the micro vibration, thereby to minimize the residual vibration may not be sufficiently obtained. When the displacement amount exceeds the above-mentioned range, the liquid drop may be discharged from the nozzle. On the other hand, when the displacement amount is within the range of 5 to 50%, the residual vibration of the piezoelectric actuator can be minimized more effectively while reliably preventing the liquid drop from being discharged from the nozzle.

A piezoelectric ink jet head according to the present invention includes the liquid discharge device according to the present invention, and is incorporated into an ink jet printer and used for discharging an ink drop as the liquid drop from the nozzle to make a drawing. Therefore, the image quality of the formed image can be always maintained at a preferable level.

A driving method for a liquid discharge device of the present invention is a method for driving a liquid discharge device including (a) a pressure chamber to be filled with a liquid, (b) a nozzle communicating with the pressure chamber, and (c) a piezoelectric actuator vibrated by application of a drive voltage and ON/OFF control of the drive voltage for discharging the liquid within the pressure chamber through the nozzle as a liquid drop, the method including the steps of discharging the liquid drop from the nozzle, and micro-vibrating the piezoelectric actuator in a range in which no liquid drop is discharged from the nozzle in a waiting time period during which no liquid drop is discharged from the nozzle.

When the liquid discharge device according to the present invention is driven by the driving method according to the present invention, to micro-vibrate the piezoelectric actuator in the waiting time period, the image quality of the formed image can be always maintained at a preferable level by suppressing the residual vibration using the mechanism previously described. Further, for example, a piezoelectric actuator in an existing liquid discharge device having no micro vibration function can be also driven by the driving method according to the present invention using an external programmable controller or the like. In the case, the image quality of a formed image can be always maintained at a preferable level by suppressing the residual vibration of the piezoelectric actuator.

It is preferable that the driving method according to the present invention includes the steps of turning the drive voltage off from a waiting state in which the drive voltage is on, and then turning the drive voltage on again to vibrate the piezoelectric actuator, thereby to discharge the liquid within the pressure chamber as the liquid drop through the nozzle, and periodically repeating the fall and the rise of the drive voltage in a range, in which the drive voltage is not turned off, immediately after the drive voltage is turned on again, to micro-vibrate the piezoelectric actuator. Furthermore, it is preferable that the driving method includes the steps of turning the drive voltage off from a waiting state in which the drive voltage is on, and then turning the drive voltage on again to vibrate the piezoelectric actuator, thereby to discharge the liquid within the pressure chamber as the liquid drop through the nozzle, and periodically repeating the fall and the rise of the drive voltage in a range, in which the drive voltage is not turned off, immediately before the drive voltage is turned off, to micro-vibrate the piezoelectric actuator.

Furthermore, it is preferable that the driving method includes the steps of turning the drive voltage off from a waiting state in which the drive voltage is on, and then turning the drive voltage on again to vibrate the piezoelectric actuator, thereby to discharge the liquid within the pressure chamber as the liquid drop through the nozzle, and repeating an operation of lowering the drive voltage, and raising the drive voltage in a range in which the drive voltage is not turned off while falling, thereby to micro-vibrate the piezoelectric actuator, on the basis of a time constant of voltage fall at the time when the drive voltage is turned off and a time constant of voltage rise at the time when the drive voltage is turned on, which are previously se in the drive circuit, in order to carry out ON/OFF control of the drive voltage to discharge the liquid drop. Furthermore, it is preferable that the driving method includes the step of micro-vibrating the piezoelectric actuator by a displacement amount that is 5 to 50% of the displacement amount of the piezoelectric actuator when ON/OFF control of the drive voltage is carried out to discharge the liquid drop. The reasons for these are as previously described.

Effects of the Invention

According to the present invention, there can be provided a liquid discharge device capable of minimizing the amplitude of residual vibration of a piezoelectric actuator to maintain the image quality of a formed image at a preferable level in the case of a piezoelectric ink jet head, for example, a piezoelectric ink jet head using the liquid discharge device, and a driving method for a liquid discharge device in which the amplitude of the residual vibration can be minimized.

BRIEF DESCRIPTION OF THE DRAWINGS

FIG. 1 is a sectional view showing an example of a liquid discharge device serving as a piezoelectric ink jet head used for an on-demand type ink jet printer or the like.

DESCRIPTION OF REFERENCE NUMERALS

Figure 1:
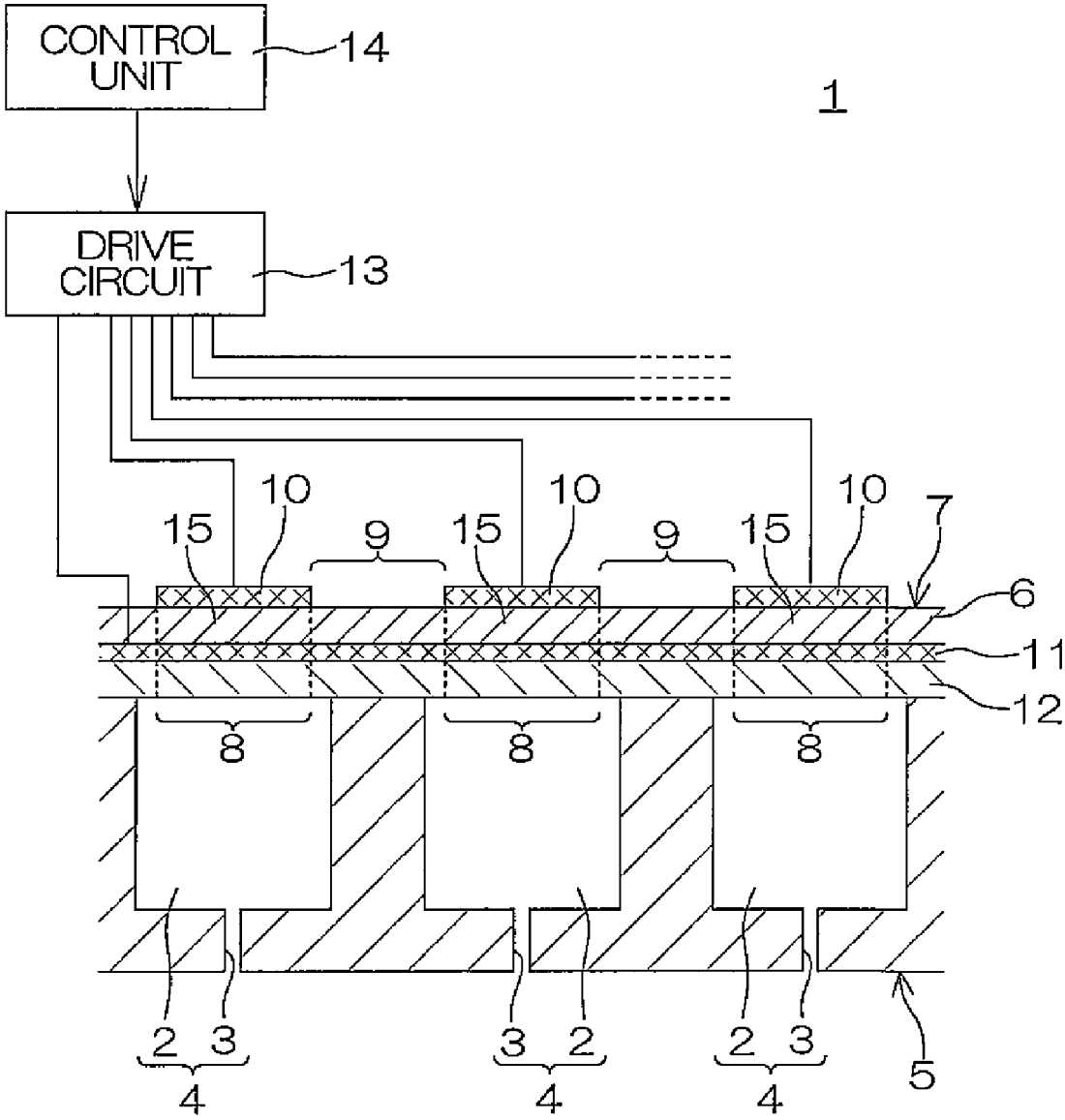

1 liquid discharge device
2 pressure chamber
3 nozzle
4 liquid drop discharge section
5 substrate
6 piezoelectric ceramic layer
7 piezoelectric actuator
8 piezoelectric deformation region
9 binding region
10 discrete electrode
11 common electrode
12 vibrating plate
13 drive circuit
14 control unit
15 active region
16 power supply line
17 ground
18 first circuit
19 ground
20 second circuit
21 terminal
22 liquid drop discharge control section
23 micro vibration control unit
24 driver
25 I/O port
$R_1$ resistor
$R_2$ resistor
$R_3$ resistor
$TR_1$ transistor
$TR_2$ transistor
$T_1$ intrinsic vibration period
$T_2$ pulse width
$T_E$ micro vibration period
$T_S$ micro vibration period
$V_P$ drive voltage
$V_C$ control signal
$V_{C1}$ control voltage
$V_H$ power supply voltage value
$V_{L1}$ voltage
$V_{L2}$ voltage
$\tau_{DN}$ time constant
$\tau_{UP}$ time constant

BEST MODE FOR CARRYING OUT THE INVENTION

Figure 2:
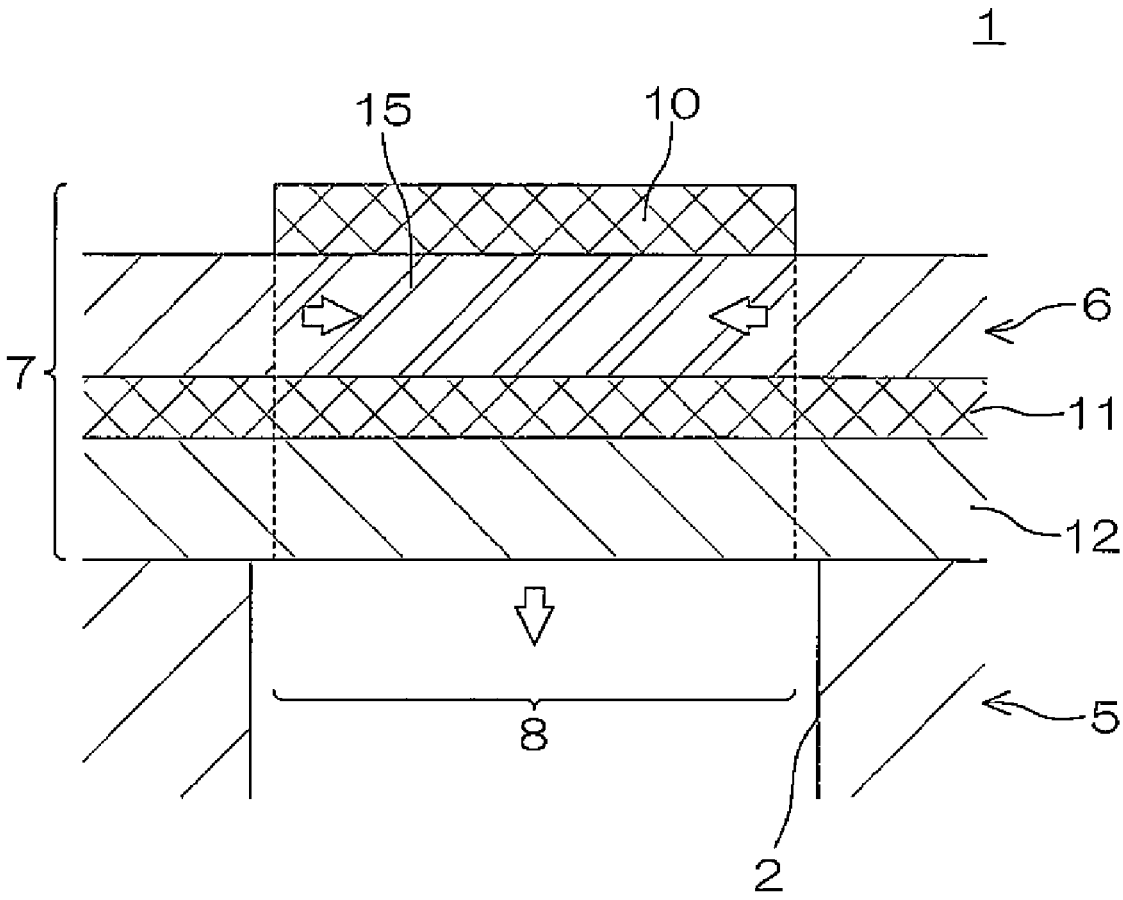
FIG. 2 is a partially enlarged sectional view of a piezoelectric actuator of the liquid discharge device shown in FIG. 1.

A liquid discharge device according to the present invention is configured similarly to the conventional liquid discharge device except that a control unit includes a micro vibration control section for micro-vibrating a piezoelectric deformation region in a piezoelectric actuator. Therefore, the outline of the whole liquid discharge device will be described using FIGS. 1 and 2 previously described. That is, FIG. 1 is a sectional view showing an example of a liquid discharge device 1 according to the present invention serving as a piezoelectric ink jet head used for an on-demand type ink jet printer or the like. FIG. 2 is a partially enlarged sectional view of a piezoelectric actuator 7 of the liquid discharge device 1 shown in FIG. 1. Referring to FIGS. 1 and 2, the liquid discharge device 1 in this example includes a substrate 5 having a plurality of liquid drop discharge sections 4 arranged therein in a planar direction, each of the liquid drop discharge sections 4 having a pressure chamber 2 to be filled with ink and a nozzle 3 communicating with the pressure chamber 2 for discharging the ink within the pressure chamber 2 as an ink drop, and a plate-shaped piezoelectric actuator 7 including a piezoelectric ceramic layer 6 having a dimension covering the plurality of pressure chambers 2 in the substrate 5 and laminated on the substrate 5.

The piezoelectric actuator 7 is partitioned into a plurality of piezoelectric deformation regions 8 respectively disposed so as to correspond to the piezoelectric chambers 2 and individually deflected and deformed in the thickness direction by individual application of a drive voltage, and a binding region 9 disposed so as to surround the piezoelectric deformation regions 8 and prevented from being deformed by being fixed to the substrate 5. Furthermore, the piezoelectric actuator 7 in the illustrated example has a so-called unimorph type configuration including discrete electrodes 10 respectively formed for the pressure chambers 2 on an upper surface of the piezoelectric ceramic layer 6 in both the drawings for defining the piezoelectric deformation regions 8, and a common electrode 11 and a vibrating plate 12 laminated in this order on a lower surface of the piezoelectric ceramic layer 6 and both having dimensions covering the plurality of pressure chambers 2. Each of the discrete electrodes 10 and the common electrode 11 are separately connected to a drive circuit 13, and the drive circuit 13 is connected to a control unit 14.

The piezoelectric ceramic layer 6 is formed of a piezoelectric material such as PZT, and is given piezoelectric deformation characteristics in a so-called transverse vibration mode by being previously polarized in the thickness direction of the layer. When a drive voltage in the same direction as the direction of the polarization is applied from the drive circuit 13 to an area between the discrete electrode 10 for defining any one of the piezoelectric deformation regions 8 and the common electrode 11, an active region 15, corresponding to the piezoelectric deformation region 8 and is sandwiched between both the electrodes 10 and 11, contracts in the planar direction of the layer, as indicated by transverse white arrows in FIG. 2. However, the lower surface of the piezoelectric ceramic layer 6 is fixed to the vibrating plate 12 through the common electrode 11. When the active region 15 contracts, therefore, the piezoelectric deformation region 8 in the piezoelectric actuator 7 is accordingly deflected and deformed so as to project toward the pressure chamber 2, as indicated by a downward white arrow in FIG. 2. When the piezoelectric deformation region 8 is vibrated by combining the state where the piezoelectric deformation region 8 is deflected and deformed and the state where the application of the drive voltage is stopped to release the deflection and deformation, the ink filled in the pressure chamber 2 is pressurized by the vibration and is discharged as an ink drop through the nozzle 3.

Figure 4:
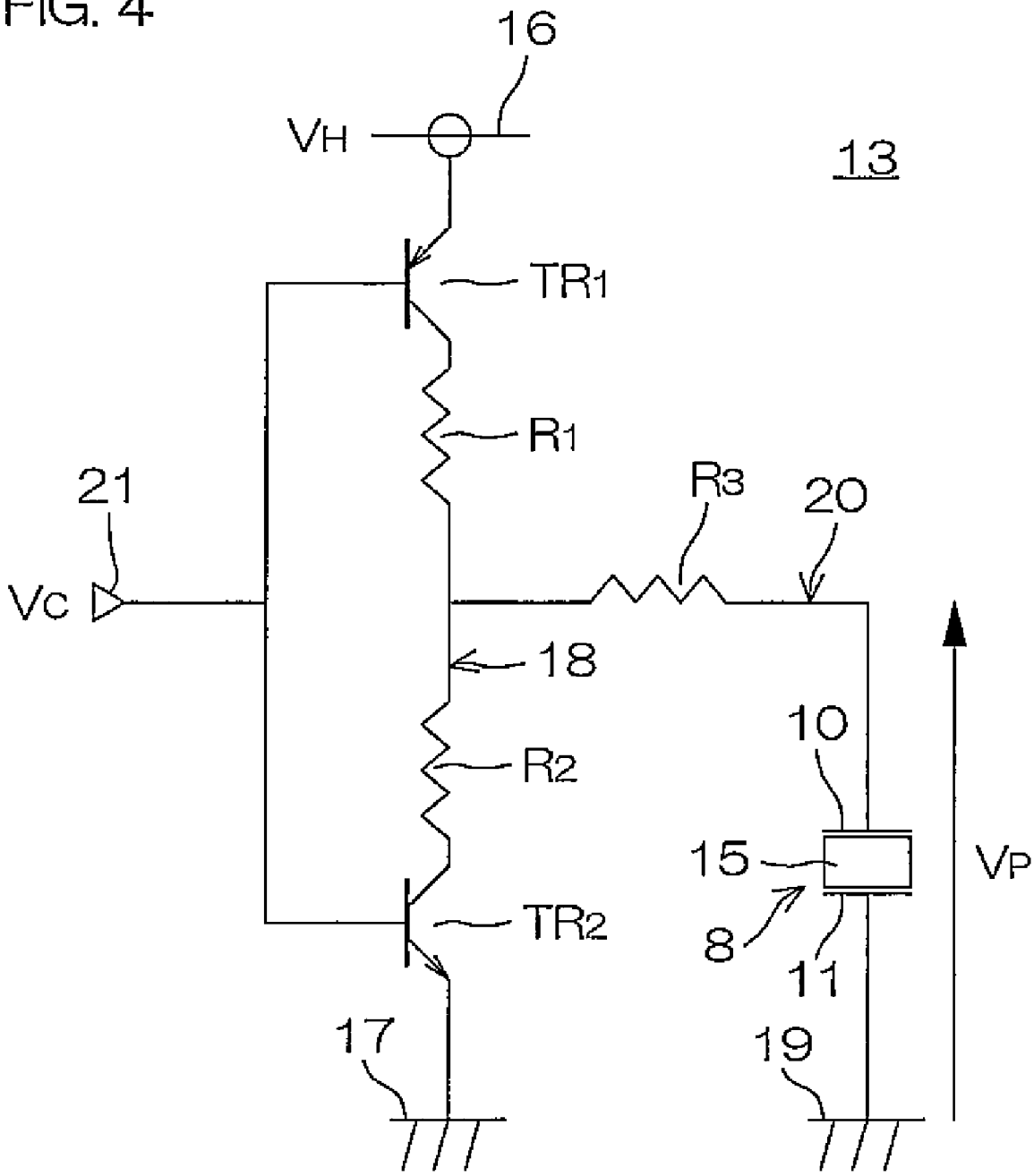
FIG. 4 is a circuit diagram showing a drive circuit for applying a drive voltage to a piezoelectric actuator.

FIG. 4 is a circuit diagram showing the drive circuit 13 for applying a drive voltage $V_P$ to the piezoelectric actuator 7. FIG. 4 illustrates a portion of the drive circuit 13 corresponding to one of the piezoelectric deformation regions 8. The actual drive circuit 13 has a configuration in which a plurality of circuits shown in FIG. 4 corresponding to the plurality of piezoelectric deformation regions 8 formed on the piezoelectric actuator 7 are integrated. Referring to FIG. 4, between a power supply line 16 and a ground 17, the drive circuit 13 includes a first circuit 18 formed by connecting in series the emitter-collector of a first transistor $TR_1$, resistors $R_1$ and $R_2$, and the collector-emitter of a second transistor $TR_2$, a second circuit 20 branched from an area between the resistors $R_1$ and $R_2$ in the first circuit 18 to lead to a ground 19 through a resistor $R_3$, the discrete electrode 10, the active region 15 in the piezoelectric ceramic layer 6 and a common electrode 11, and a terminal 21 connected to the respective bases of both the transistors $TR_1$ and $TR_2$ for inputting a control signal $V_C$ from the control unit 14 to the respective bases of both the transistors $TR_1$ and $TR_2$. The discrete electrode 10, the active region 15 and the common electrode 11 constitute the piezoelectric deformation region 8, and equivalently function as a capacitor.

Figure 5:
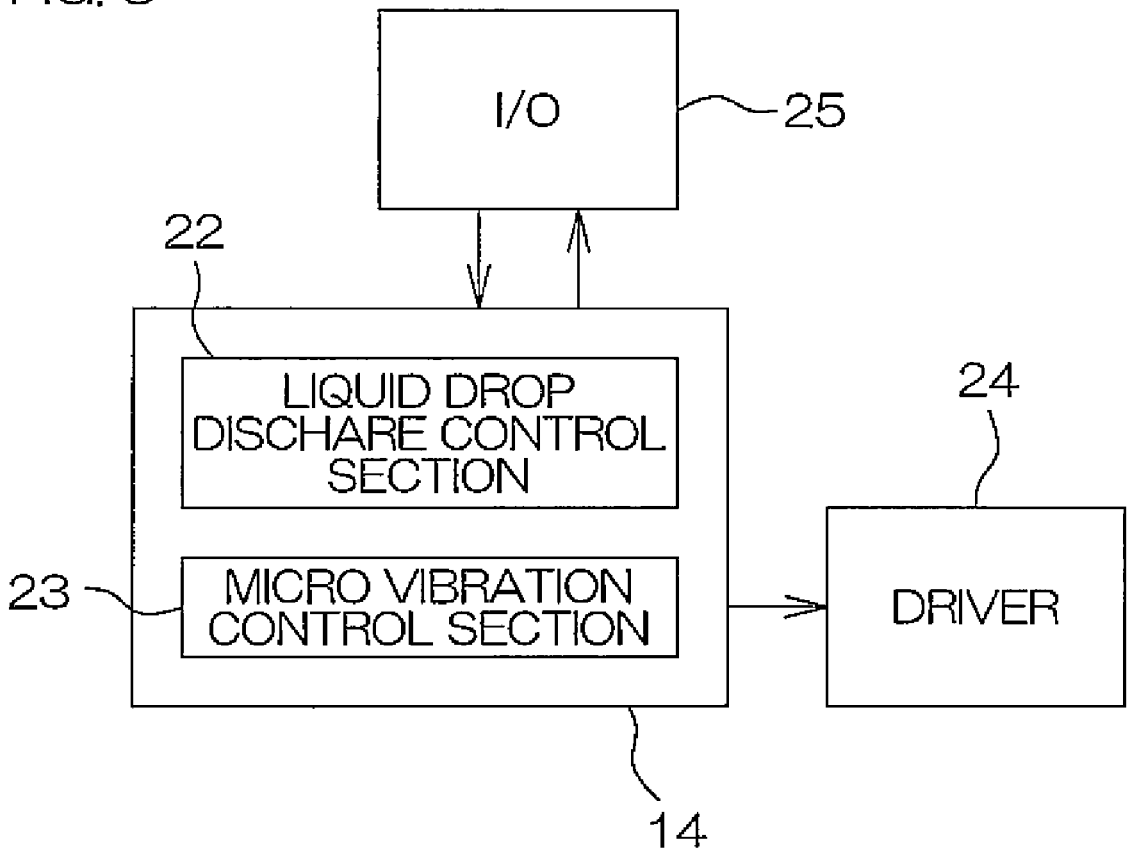
FIG. 5 is a block diagram showing an example of the internal configuration of a control unit for carrying out ON/OFF control of a drive voltage applied to a piezoelectric actuator from a drive circuit.

FIG. 5 is a block diagram showing an example of the internal configuration of the control unit 14 for carrying out ON/OFF control of the drive voltage $V_P$ applied to the piezoelectric actuator 7 from the drive circuit 13. Referring to FIGS. 1, 4 and 5, the control unit 14 in this example includes a liquid drop discharge control section 22 for carrying out for each of the piezoelectric deformation regions 8 ON/OFF control of a drive voltage applied to the piezoelectric deformation region 8 from the drive circuit 13 to drive any one of the piezoelectric deformation regions 8 using a normal Pull-push driving method, thereby to generate a control signal $V_C$ for carrying out control to discharge an ink drop for image formation from the corresponding nozzle 3, and a micro vibration control section 23 for carrying out ON/OFF control of the drive voltage in a waiting time period during which no ink drop is discharged from the nozzle 3, to generate a control signal $V_C$ for carrying out control to micro-vibrate the piezoelectric deformation region 8.

The control signals $V_C$ respectively generated by the liquid drop discharge control section 22 and the micro vibration control section 23 are outputted through a driver 24 and are inputted to the terminal 21 in the drive circuit 13. Furthermore, the control unit 14 is provided with an I/O port 25 to which a personal computer (PC) (not shown) is connected for receiving a data signal or the like relating to a formed image and transmitting a signal notifying the PC or the like of the current conditions of the ink jet printer, such as end of printing.

The control signal $V_C$ from the liquid drop discharge control section 22 is individually inputted to the terminal 21 for each portion, corresponding to each of the piezoelectric deformation regions 8, in the drive circuit 13 shown in FIG. 4 on the basis of the data signal relating to the formed image, for example. By individually carrying out for each of the piezoelectric deformation regions 8 ON/OFF control of the drive voltage $V_P$ applied to the piezoelectric deformation region 8 from the drive circuit 13, as previously described, on the basis of the inputted control signal $V_C$, any one of the piezoelectric deformation regions 8 is individually driven, so that an ink drop is discharged from the corresponding nozzle 3, to form an image on a paper surface.

Figure 6:
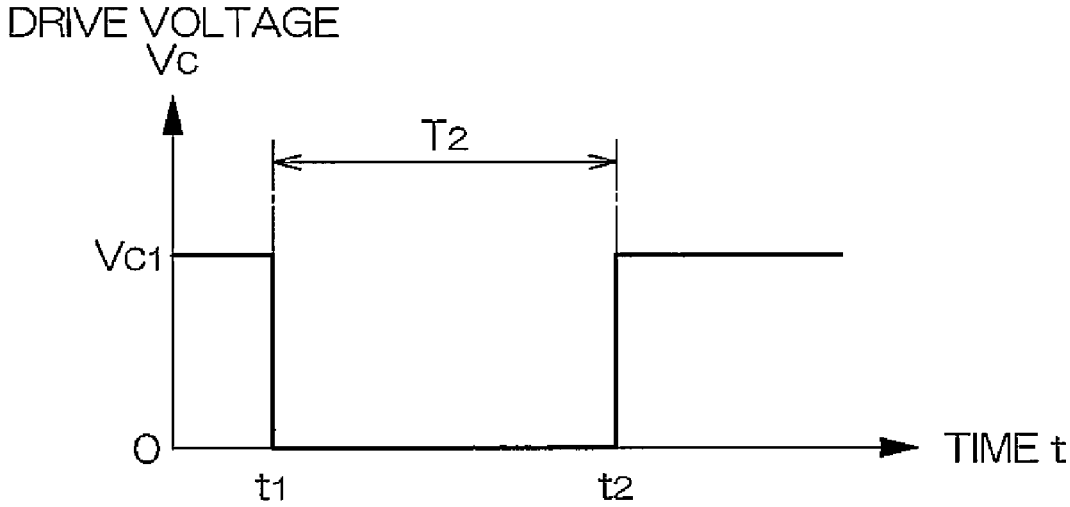
FIG. 6 is a graph showing a voltage waveform of a control signal inputted to a terminal of a drive circuit from a control unit for carrying out ON/OFF control of a drive voltage when a normal Pull-push driving method is carried out.
Figure 7:
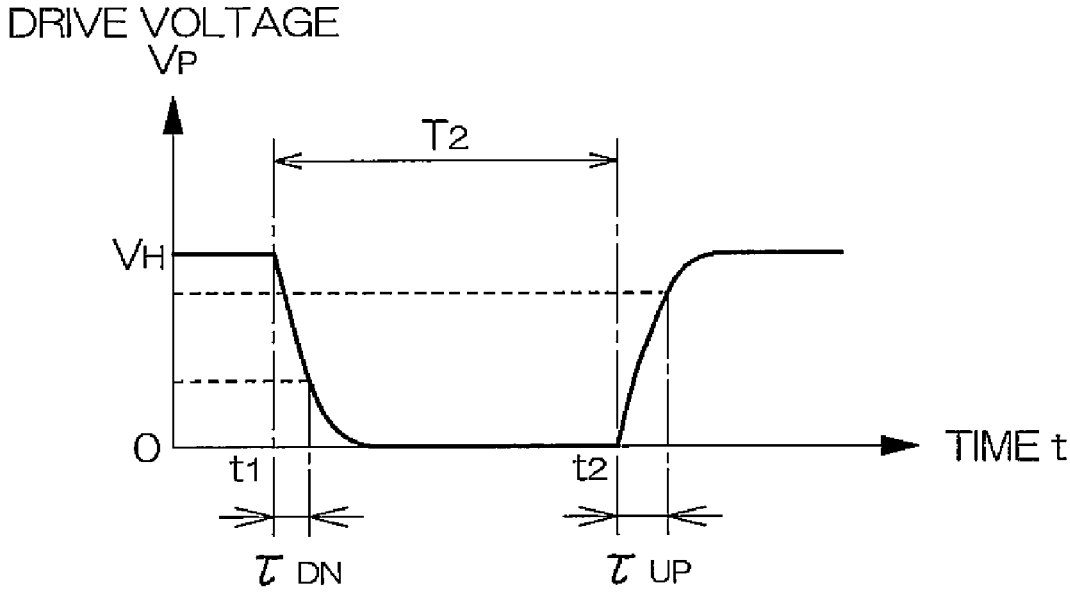
FIG. 7 is a graph showing a drive voltage waveform generated by ON/OFF control of a drive voltage applied to a piezoelectric actuator from a drive circuit when the control signal is inputted.

FIG. 6 is a graph showing a voltage waveform of the control signal $V_C$ for carrying out ON/OFF control of the drive voltage $V_P$, inputted to one terminal 21 in the drive circuit 13 from the control unit 14 when a normal Pull-push driving method is carried out. FIG. 7 is a graph showing a drive voltage waveform generated by ON/OFF control of the drive voltage $V_P$ applied from the drive circuit 13 to the corresponding piezoelectric deformation region 8 in the piezoelectric actuator 7 when the control signal $V_C$ is inputted. Referring to FIGS. 1 and 4 to 7, in the normal Pull-push driving method, the liquid drop discharge control section 22 in the control unit 14 functions, and in a waiting time period on the left of $t_1$ in FIGS. 6 and 7 during which no ink drop is discharged from the nozzle 3, the liquid drop discharge control section 22 maintains a state where a predetermined control voltage $V_{C1}$ is inputted ($V_C$=$V_{C1}$) to the respective bases of both the transistors $TR_1$ and $TR_2$ through the terminal 21.

Therefore, the emitter-collector of the first transistor $TR_1$ is turned on and the collector-emitter of the second transistor $TR_2$ is turned off, so that the drive voltage $V_P$ corresponding to a power supply voltage $V_H$ ($V_P$=$V_H$) of the power supply line 16 is continuously applied from the power supply line 16 to an area between the discrete electrode 10 and the common electrode 11 that constitute the piezoelectric deformation region 8 through the emitter-collector of the first transistor $TR_1$ and the resistors $R_1$ and $R_3$. The active region 15 continues to contract in the planar direction as previously described, so that the piezoelectric deformation region 8 is deflected and deformed so as to project toward the pressure chamber 2, thereby to maintain a state where the volume of the pressure chamber 2 is decreased.

At the time point of $t_1$, the liquid drop discharge control section 22 stops the control voltage $V_{C1}$ ($V_C$=0V) applied to the respective bases of both the transistors $TR_1$ and $TR_2$ through the terminal 21. Thus, the emitter-collector of the first transistor $TR_1$ is turned off and the collector-emitter of the second transistor $TR_2$ is turned on, so that the drive voltage $V_P$ applied to the active region 15 is discharged to the ground 17 through the resistors $R_3$ and $R_2$ and the collector-emitter of the second transistor $TR_2$.

At this time, the drive voltage $V_P$ falls on the basis of the following equation (i) from $V_H$, to reach 0V ($V_P$=0V) in time:

$$V_P=V_H\times\exp[-t_{DN}/\tau_{DN}] \quad \text{(i)}$$

Figure 3:
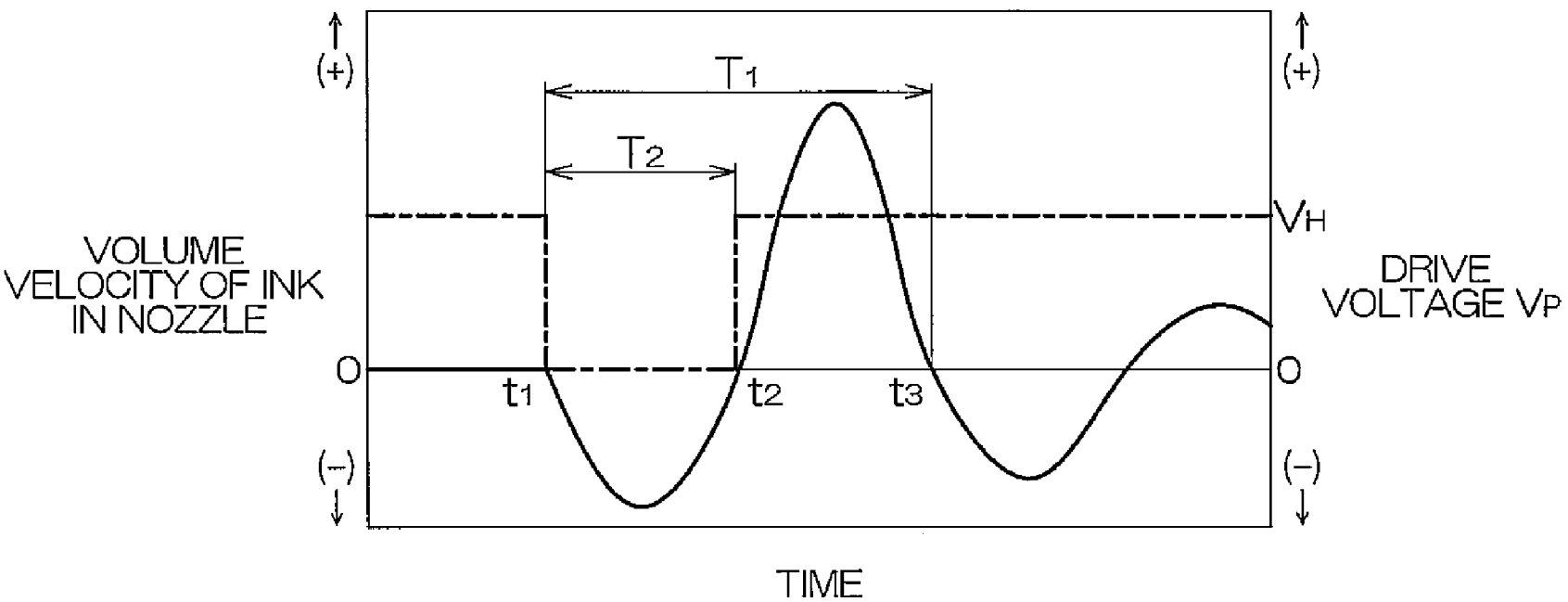
FIG. 3 is a graph showing in simplified fashion a relationship between an example of a drive voltage waveform generated by ON/OFF control of a drive voltage applied to a piezoelectric actuator from a drive circuit when the liquid discharge device shown in FIG. 1 is driven by a normal Pull-push driving method, and a change in volume velocity of ink within a nozzle occurring when the drive voltage waveform is applied.

[in the equation, $t_{DN}$ is an elapsed time from $t_1$, and $\tau_{DN}$ is a time constant of voltage fall at the fall of a drive voltage waveform generated by discharging the drive voltage $V_P$ from $V_H$ to 0V.] The time constant $\tau_{DN}$ is obtained by the following equation (ii):

$$\tau_{DN}=C_P\times(r_2+r_3) \quad \text{(ii)}$$

in the equation, $C_P$ is the capacitance of the active region 15 as a capacitor, and $r_2$ and $r_3$ are respectively the resistance values of the resistors $R_2$ and $R_3$. This causes the contraction of the active region 15 to be released while causing the deflection of the piezoelectric deformation region 8 to be released. Therefore, the volume of the pressure chamber 2 is increased, so that the intrinsic vibration (see FIG. 3) of the volume velocity of ink, previously described, is started. Note that the capacitance $C_P$ of the active region 15 as a capacitor is defined by the area of the active region 15 (the area of the discrete electrode 10), the type and the constituent of a ceramic material forming the piezoelectric ceramic layer 6, the thickness of the piezoelectric ceramic layer 6, and so on.

Then, at the time point of $t_2$ where a time $T_2$ that is approximately one-half an intrinsic vibration period $T_1$ of the volume velocity of ink has elapsed from the time point $t_0$, the liquid drop discharge control section 22 applies the control voltage $V_{C1}$ ($V_C$=$V_{C1}$) again to the respective bases of both the transistors $TR_1$ and $TR_2$ through the terminal 21. Then, the emitter-collector of the first transistor $TR_1$ is turned on and the collector-emitter of the second transistor $TR_2$ is turned off, so that the active region 15 starts to be charged again from the power supply line 16 through the emitter-collector of the first transistor $TR_1$, the resistors $R_1$ and $R_3$, and the discrete electrode 10.

At this time, the drive voltage $V_P$ rises on the basis of the following equation (iii) from 0V, to reach $V_H$ ($V_P$=$V_H$) in time:

$$V_P=V_H\times[1-\exp[-t_{UP}/\tau_{UP}]] \quad \text{(iii)}$$

[in the equation, $t_{UP}$ is an elapsed time from $t_2$, and $\tau_{UP}$ is a time constant of voltage rise at the rise of a drive voltage waveform generated by charging the drive voltage from 0V to $V_H$.] The time constant $\tau_{UP}$ is obtained by the following equation (iv):

$$\tau_{UP}=C_P\times(r_1+r_3) \quad \text{(iv)}$$

in the equation, $C_P$ is the capacitance of the active region 15 as a capacitor, and $r_1$ and $r_3$ are respectively the resistance values of the resistors $R_1$ and $R_3$. This causes the active region 15 to contract again while causing the piezoelectric deformation region 8 to be deflected, so that the volume of the pressure chamber 2 is decreased. Therefore, an ink column projects from the tip of the nozzle, is separated in time, and flies to a paper surface as an ink drop to form a dot.

Figure 8:
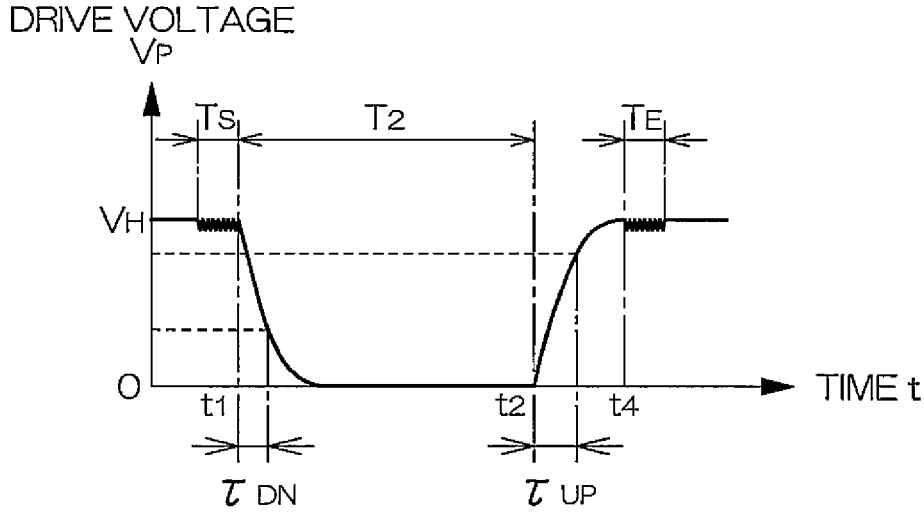
FIG. 8 is a graph showing a drive voltage waveform generated by ON/OFF control of a drive voltage applied to a piezoelectric actuator from a drive circuit when a driving method according to the present invention is carried out.
Figure 9:
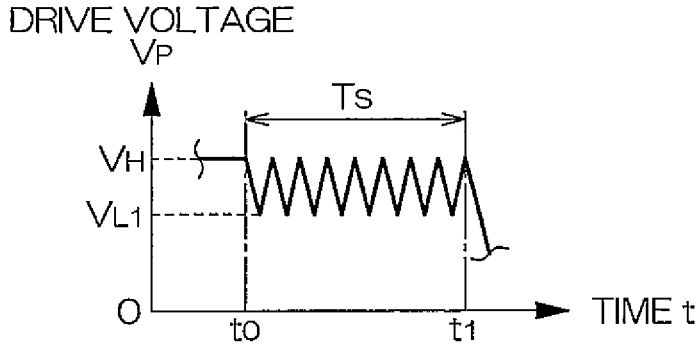
FIG. 9 is a graph showing the drive voltage waveform in the vicinity of $t_1$ shown in FIG. 8 in enlarged fashion.
Figure 10:
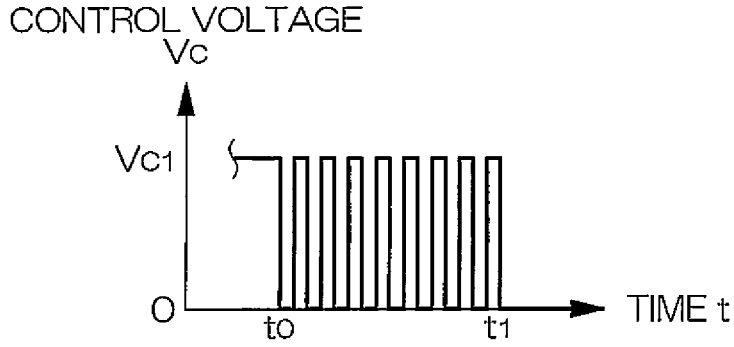
FIG. 10 is a graph showing a voltage waveform of a control signal inputted to a terminal of a drive circuit from a control unit for carrying out ON/OFF control of a drive voltage in order to generate the drive voltage waveform shown in FIG. 9.
Figure 11:
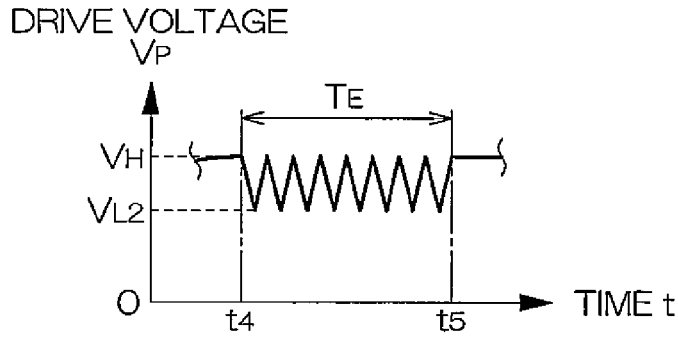
FIG. 11 is a graph showing the drive voltage waveform in the vicinity of $t_4$ shown in FIG. 8 in enlarged fashion.
Figure 12:
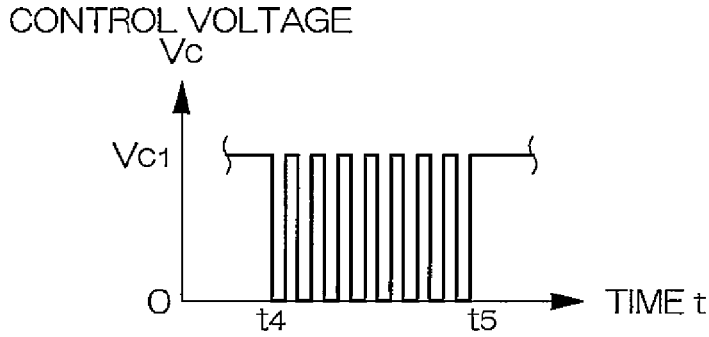
FIG. 12 is a graph showing a voltage waveform of a control signal inputted to a terminal of a drive circuit from a control unit for carrying out ON/OFF control of a drive voltage in order to generate the drive voltage waveform shown in FIG. 11.

FIG. 8 is a graph showing a drive voltage waveform generated by ON/OFF control of the drive voltage $V_P$ applied to any one of the piezoelectric deformation regions 8 in the piezoelectric actuator 7 from the drive circuit 13, when the driving method according to the present invention is carried out. FIG. 9 is a graph showing a drive voltage waveform in the vicinity of $t_1$ shown in FIG. 8 in enlarged fashion. FIG. 10 is a graph showing a voltage waveform of the control signal $V_C$ inputted to any one of the terminals 21 in the drive circuit 13 from the control unit 14 for carrying out ON/OFF control of the drive voltage $V_P$, in order to generate the drive voltage waveform shown in FIG. 9. FIG. 11 is a graph showing a drive voltage waveform in the vicinity of $t_4$ shown in FIG. 8 in enlarged fashion. FIG. 12 is a graph showing a voltage waveform of the control signal $V_C$ inputted to any one of the terminals 21 in the drive circuit 13 from the control unit 14 for carrying out ON/OFF control of the drive voltage $V_P$, in order to generate the drive voltage waveform shown in FIG. 11.

Referring to each of the drawings, a basic operation part for discharging an ink drop in the driving method in this example is the same as the normal Pull-push driving method previously described, and the liquid drop discharge control section 22 in the control unit 14 functions to discharge the ink drop. The present invention differs from the prior art in the following points:

(I) Over a predetermined time period (referred to as a "micro vibration time period") $T_S$ from $t_O$ to $t_1$ elapsed from a waiting state before $t_1$ until the time when the drive voltage $V_P$ is turned off to fall in order to discharge an ink drop at the time point of $t_1$, the micro vibration control section 23 in the control unit 14 functions to repeat the fall and the rise of the drive voltage $V_P$ periodically in a range in which the drive voltage is not turned off, (II) Over a predetermined time period (referred to as a "micro vibration time period") $T_E$ from $t_4$ to $t_5$ elapsed from the time point of $t_4$ where $V_P$=$V_H$ is established by turning the drive voltage $V_P$ on again to rise at the time point of $t_2$ where the time $T_2$ that is approximately one-half the intrinsic vibration period $T_1$ of the volume velocity of ink has elapsed from the time $t_0$, the micro vibration control section 23 similarly functions to repeat the fall and the rise of the drive voltage $V_P$ periodically in a range in which the drive voltage is not turned off, thereby micro-vibrating the piezoelectric deformation region 8. The voltage control (I) and the voltage control (II) are carried out using the drive circuit 13 shown in FIG. 4, similarly to the ON/OFF control carried out when the ink drop is discharged.

Referring to FIGS. 4, 5 and 8 to 10, in the voltage control (I), the micro vibration control section 23 first stops the control voltage $V_{C1}$ applied to the respective bases of both the transistors $TR_1$ and $TR_2$ ($V_C$=0V) at the time point of $t_O$ during waiting, to lower the drive voltage $V_P$ from $V_H$ on the basis of the foregoing equation (i). Then, the control voltage $V_{C1}$, is applied again ($V_C$=$V_{C1}$) to the respective bases of both the transistors $TR_1$ and $TR_2$ at a time point where the lowered drive voltage $V_P$ reaches a voltage $V_{L1}$ slightly lower than the voltage $V_H$, thereby to raise the drive voltage $V_P$ from $V_{L1}$ on the basis of the foregoing equation (iii), and the control voltage $V_{C1}$ is then stopped ($V_C$=0V) again at a time point where the raised drive voltage $V_P$ reaches $V_H$, to lower the drive voltage $V_P$ on the basis of the foregoing equation (i).

When the above-mentioned operation is repeated over the micro vibration time period $T_s$ from $t_0$ to $t_1$, the residual vibration of the piezoelectric deformation region 8 in the piezoelectric actuator 7 can be forcibly caused to coincide with the micro vibration by micro-vibrating the piezoelectric deformation region 8. If the amplitude of micro vibration defined by a potential difference between the voltages $V_H$ and $V_{L1}$ is set to a minimum range, an ink meniscus can be stabilized in a stationary state by maintaining the amplitude of the residual vibration in the same range at the time point of $t_1$ where the discharge of an ink drop is started. Since the size and the shape of the ink drop discharged from the nozzle 3 through a series of processes in the Pull-push driving can be made constant for each of the liquid drop discharge sections 4 or for each operation in each of the liquid drop discharge sections 4. Therefore, the image quality of a formed image can be always maintained at a preferable level by preventing the size of a dot formed on a paper surface from varying.

Referring to FIGS. 4, 5, 8, 11 and 12, in the voltage control (II), the micro vibration control section 23 first stops the control voltage $V_{C1}$ applied to the respective bases of both the transistors $TR_1$ and $TR_2$ ($V_C$=0V) at the time point of $t_4$ where the drive voltage $V_P$ reaches $V_H$ upon termination of the Pull-push driving, to lower the drive voltage $V_P$ from $V_H$ on the basis of the foregoing equation (i). Then, the control voltage $V_{C1}$ is applied ($V_C$=$V_{C1}$) again to the respective bases of both the transistors $TR_1$ and $TR_2$ at a time point where the drive voltage $V_P$ reaches $V_{L2}$ slightly lower than the voltage $V_H$, thereby to raise the drive voltage $V_P$ from $V_{L2}$ on the basis of the foregoing equation (iii), and the control voltage $V_{C1}$ is stopped ($V_C$=0V) again at a time point where the raised drive voltage $V_P$ reaches $V_H$, to lower the drive voltage $V_P$ on the basis of the foregoing equation (i).

When the above-mentioned operation is repeated over the micro vibration time period $T_E$ from $t_4$ to $t_5$, the residual vibration of the piezoelectric deformation region 8 in the piezoelectric actuator 7 at the time point (the time point $t_3$ in FIG. 3) where an ink column generated by the Pull-push driving method is separated to form an ink drop by micro-vibrating the piezoelectric deformation region 8 can be forcibly caused to coincide with the micro vibration. If the amplitude of the micro vibration defined by the potential difference between the voltages $V_H$ and $V_{L2}$ is set to a minimum range, therefore, the conditions where an ink column is separated to form an ink drop (the position and the direction in which the ink column is separated) can be always kept constant by maintaining the amplitude of the residual vibration in the same range, which can prevent the flying direction of the ink drop from being bent or prevent mist from being generated. Therefore, the image quality of a formed image can be always maintained at a preferable level. The piezoelectric deformation region 8 in the waiting state where no ink drop is discharged from the nozzle 3 may be continuously micro-vibrated during the waiting time period, may be maintained in a stationary state without being micro-vibrated, or may be repeatedly micro-vibrated at desired intervals.

The configuration of the present invention is not limited to the examples illustrated in the drawings described above. For example, either one of the voltage control (I) and voltage control (II) may be carried out. The only one voltage control (I) or (II) allows the image quality of a formed image to be maintained at a preferable level by suppressing the residual vibration of the piezoelectric deformation region 8 because it is repeatedly carried out for each discharge of an ink drop. Furthermore, the piezoelectric deformation region 8 may be continuously micro-vibrated from the time point of $t_4$ where the discharge of the ink drop is terminated to the time point of $t_1$ where the subsequent ink drop is discharged, i.e., may be continuously micro-vibrated by successively performing the operations for the voltage control (I) and the voltage control (II). Alternatively, a mode in which at least one of the voltage control (I) and the voltage control (II) is carried out, and a mode in which neither the voltage control (I) nor the voltage control (II) is carried out, i.e., the normal Pull-push driving method, may be selectively carried out.

The smaller the amplitude of the micro vibration of the piezoelectric deformation region 8 generated by the voltage control (I) or (II) is, the less the image quality of a formed image can be affected. When the amplitude is too small, however, a time period required until the residual vibration of the piezoelectric deformation region 8 is caused to coincide with the micro vibration is lengthened, so that the generated residual vibration may not, in some cases, be able to be forcibly caused to coincide with the micro vibration to minimize the amplitude thereof within a time period from the time when the ink drop is discharged to the subsequent ink drop is discharged. Therefore, the amplitude of the micro vibration must be set to a suitable range. However, the most suitable range of the amplitude of the micro vibration differs depending on the configuration of the liquid discharge device 1, the size and the shape of each of the components, and so on. Therefore, a suitable range cannot unconditionally be defined.

However, it is preferable that the ratio of the displacement amount, corresponding to a potential difference $V_H$-$V_{L1}$ or $V_H$-$V_{L2}$ of the drive voltage $V_P$, of the piezoelectric deformation region 8 at the time of the micro vibration with respect to the displacement amount of the piezoelectric deformation region 8 at the time when ON/OFF control of the drive voltage $V_P$ is carried out between $V_H$ and 0V in order to discharge an ink drop from the nozzle 3 is approximately 5 to 50%, particularly 5 to 40%, and further 10 to 30% when it is expressed in percentage. When the displacement amount at the time of the micro vibration of the piezoelectric deformation region 8 is less than the above-mentioned range, the effect of forcibly causing the residual vibration caused by micro-vibrating the piezoelectric deformation region 8 to coincide with the micro vibration thereby to minimize the residual vibration may not be sufficiently obtained. When the displacement amount exceeds the above-mentioned range, a liquid drop may be discharged from the nozzle 3. On the other hand, when the displacement amount is within the above-mentioned range, the residual vibration of the piezoelectric deformation region 8 can be minimized more effectively while reliably preventing the liquid drop from being discharged from the nozzle 3.

In the illustrated example, the pulse width of the control signal $V_C$ inputted to the drive circuit 13 shown in FIG. 4 is adjusted as shown in FIGS. 10 and 12, to repeat an operation of lowering the drive voltage $V_P$ on the basis of the previously set time constant $\tau_{DN}$ of voltage fall at the time when the drive voltage is turned off which is defined by the capacitance $C_P$ of the active region 15 as a capacitor and the resistances $r_2$ and $r_3$ of the resistors $R_2$ and $R_3$ in the drive circuit 13, and raising the drive voltage $V_P$ on the basis of the previously set time constant $\tau_{UP}$ of voltage rise at the time when the drive voltage is turned on which is defined by the capacitance $C_P$ and the resistances $r_1$ and $r_3$ of the resistors $R_1$ and $R_3$ in the drive circuit 13 in a range in which the drive voltage is not turned off while falling, thereby to micro-vibrate the piezoelectric deformation region 8 in the piezoelectric actuator 7. That is, in the illustrated example, the piezoelectric deformation region 8 in the piezoelectric actuator 7 is micro-vibrated depending on the transient phenomenon of the piezoelectric actuator 7. The displacement amount in the micro vibration is controlled by adjusting the pulse width of the control signal.

However, the piezoelectric deformation region 8 in the piezoelectric actuator 7 can be also micro-vibrated without depending on the transient phenomenon. For example, when the time constants $\tau_{DN}$ and $\tau_{UP}$ defined by the capacitance $C_P$ and the resistances $r_1$, $r_2$ and $r_3$ of the resistors $R_1$, $R_2$ and $R_3$ depending on the size, the shape and so on of the piezoelectric actuator 7 are small, and therefore, control dependent on the transient phenomenon is difficult, for example, the piezoelectric deformation region 8 in the piezoelectric actuator 7 may be micro-vibrated by changing the drive voltage $V_P$ generated in the drive circuit 13 between the voltage $V_H$ and the voltage $V_{L2}$ that is lower than the voltage $V_H$, assuming that the control signal $V_C$ inputted to the drive circuit 13 shown in FIG. 4 is not an ON/OFF binary waveform shown in FIGS. 10 and 12 but is repeatedly changed between the control voltage $V_{C1}$ and the control voltage $V_{C2}$ that is lower than the control voltage $V_{C1}$ but is not 0V. The displacement amount in the micro vibration can be controlled by adjusting the voltage value $V_{C2}$ of the control signal.

Although in the illustrated example, ON/OFF control of the drive voltage for discharging an ink drop and voltage control for micro vibration are carried out using the same drive circuit 13 shown in FIG. 4, they may be respectively carried out by separate circ inherently have a micro vibration function, other than the liquid discharge device 1 according to the present invention, as previously described. In this case, an external programmable controller may be connected to the liquid discharge device. Alternatively, the control unit 14 may be replaced with one including a micro vibration control section 23. In addition thereto, various changes can be made without departing from the scope of the present invention.

EXAMPLES

«Example 1»

Figure 13:
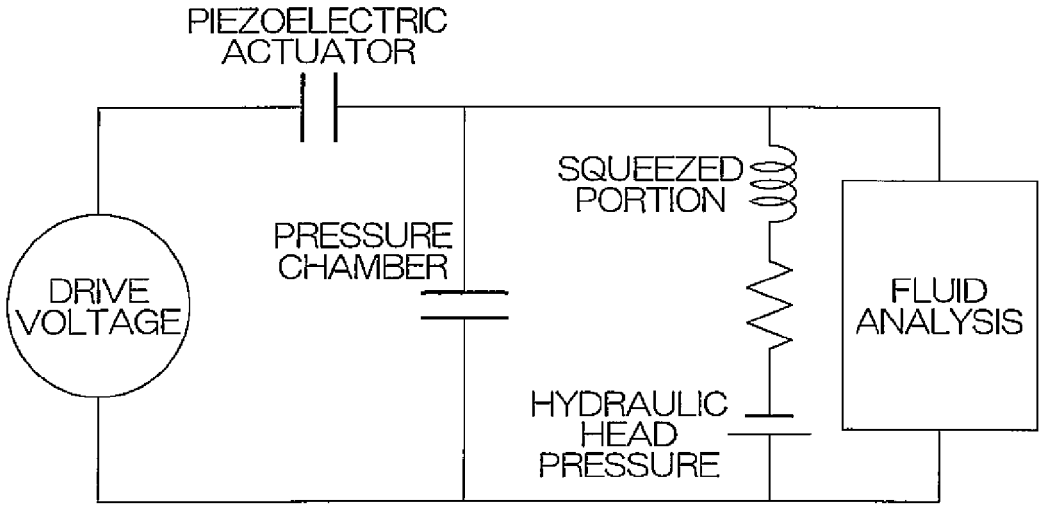
FIG. 13 is a circuit diagram showing an analysis model used for analyzing a liquid discharge device prepared in Examples.
Figure 14:
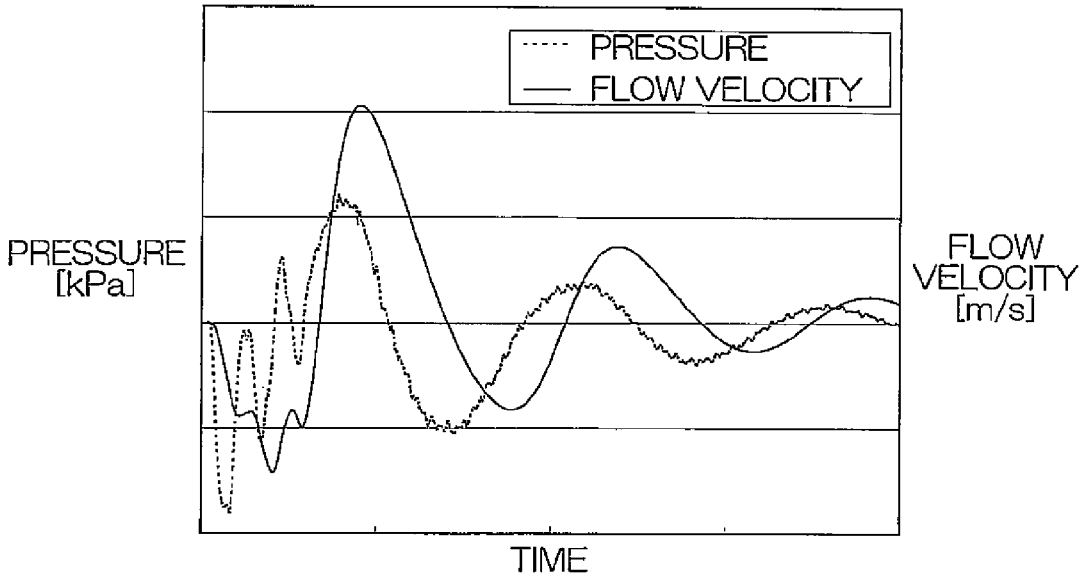
FIG. 14 is a graph showing results obtained by analyzing changes in pressure and flow velocity of ink occurring at an end of a nozzle on the side of a pressure chamber using the analysis model when the liquid discharge device is driven by a drive voltage having the drive voltage waveform shown in FIG. 8.
Figure 15:
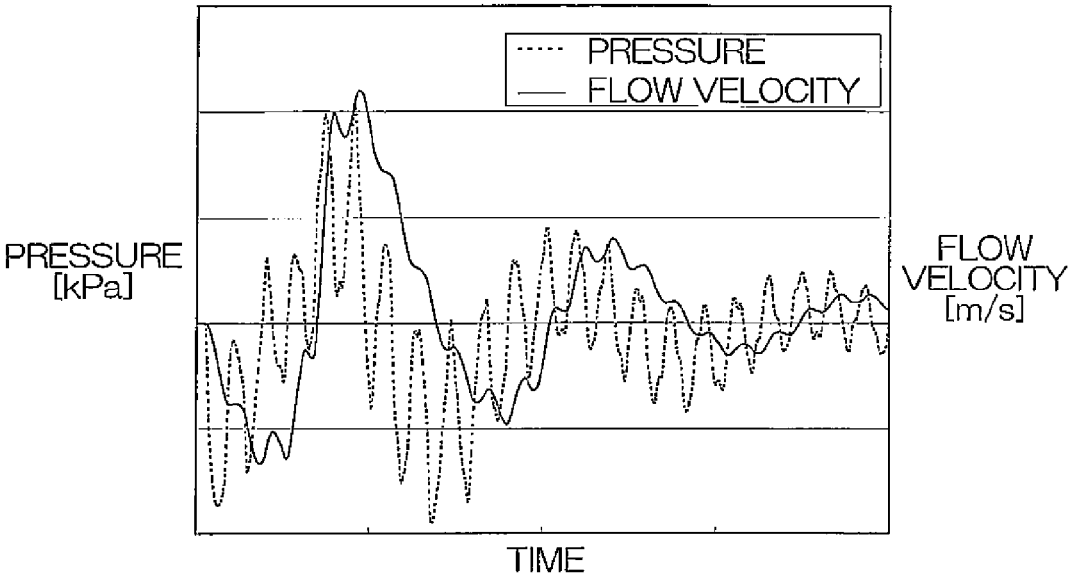
FIG. 15 is a graph showing results obtained by analyzing changes in pressure and flow velocity of ink occurring at an end of a nozzle on the side of a pressure chamber using the analysis model when the liquid discharge device is driven by a drive voltage having the drive voltage waveform shown in FIG. 7.
Figure 16:
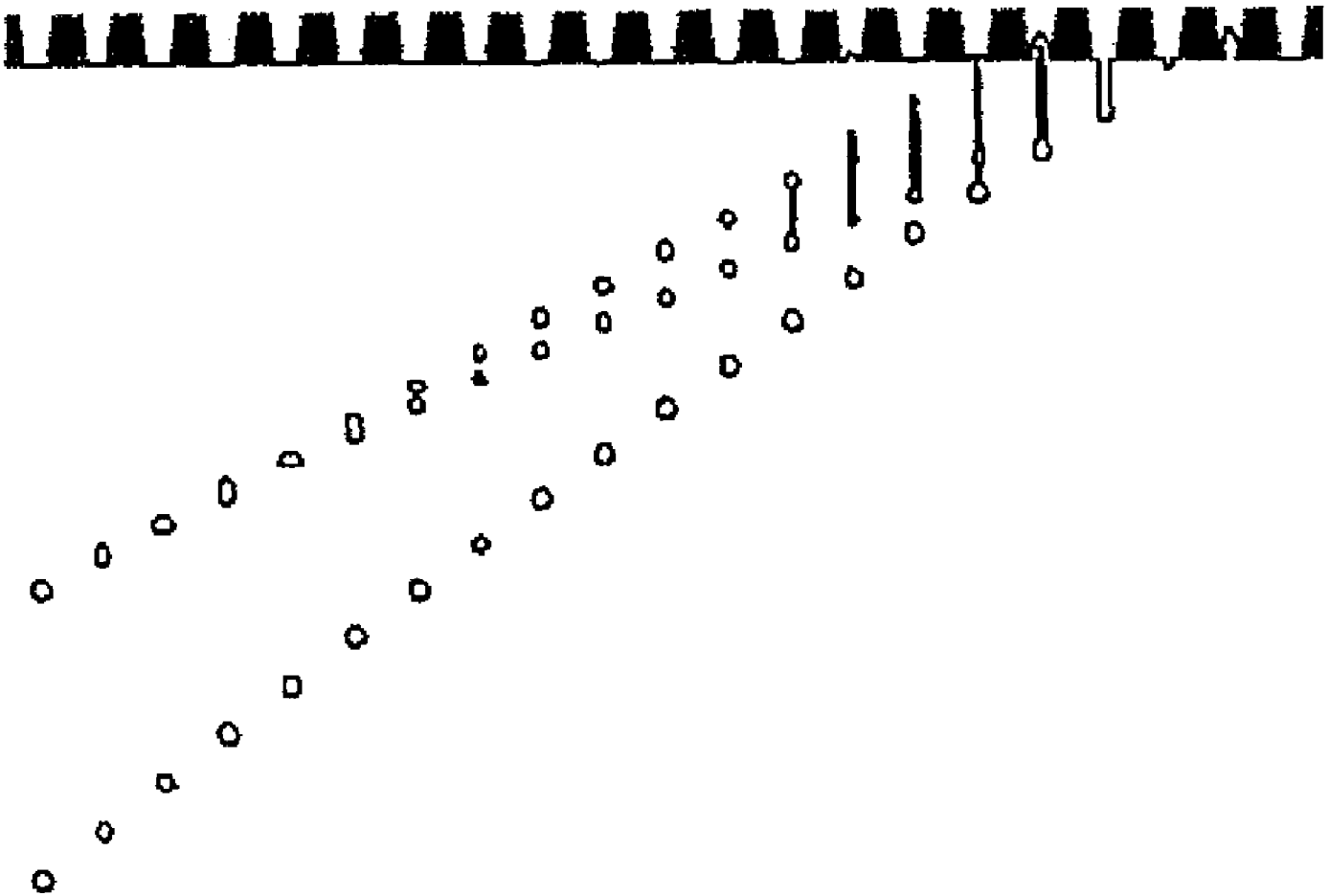
FIG. 16 is a diagram showing results obtained by calculating the flying speed, the volume and the shape of an ink drop discharged from a nozzle when the liquid discharge device is driven by a drive voltage having the drive voltage waveform shown in FIG. 8, on the basis of the results of the analysis shown in FIG. 14.
Figure 17:
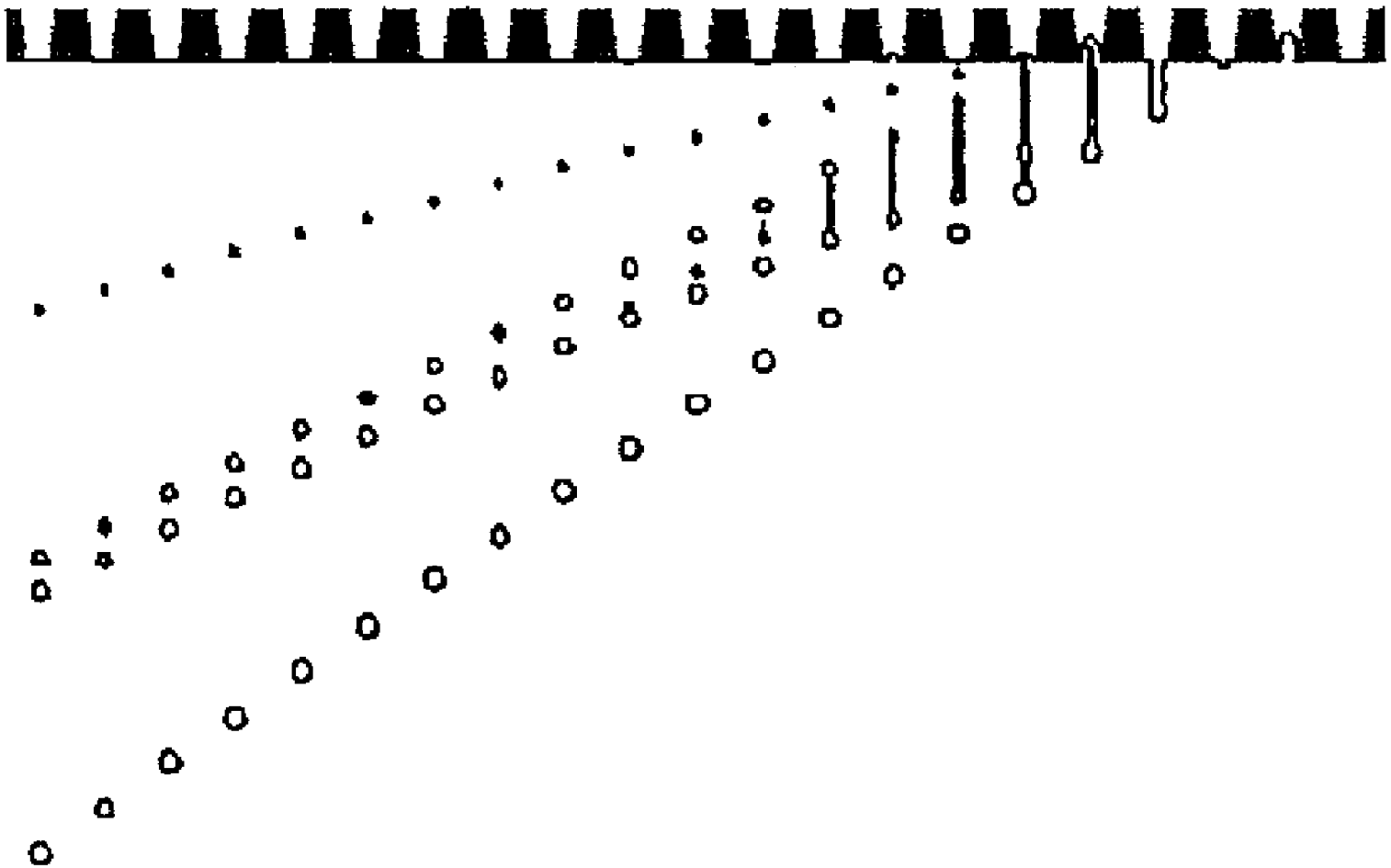
FIG. 17 is a diagram showing results obtained by calculating the flying speed, the volume and the shape of an ink drop discharged from a nozzle when the liquid discharge device is driven by a drive voltage having the drive voltage waveform shown in FIG. 7, on the basis of the results of the analysis shown in FIG. 15.

A liquid discharge device 1 serving as a piezoelectric ink jet head, which has the configuration shown in FIG. 1 and in which the resonance period of residual vibration of a piezoelectric actuator 8 was 1.4 μsec, was prepared. Fluid analysis of respective changes in the pressure and the flow velocity of ink occurring at an end of a nozzle 3 on the side of a pressure chamber 2 when either one of the following two types of drive voltages was applied from a drive circuit 13 to any one of piezoelectric deformation regions 8 in the piezoelectric actuator 7 of the liquid discharge device 1 was conducted by a pseudo compression method using an analysis model shown in FIG. 13. Results obtained when a drive voltage A was applied is shown in FIG. 14 and results obtained when a drive voltage B was applied is shown in FIG. 15. Furthermore, the flying speed, the volume and the shape of an ink drop discharged from the nozzle 3 were calculated on the basis of the results of the analysis. The results obtained when the drive voltage A was applied is shown in FIG. 16 and the results obtained when the drive voltage B was applied is respectively shown in FIG. 17.

(Drive Voltage A)

The drive voltage A is a drive voltage having a drive voltage waveform shown in FIG. 8 and having a voltage value $V_H$ of 15V in a waiting time period, having a pulse width $T_2$ of 6.2 μsec, having time constants $\tau_{DN}$ and $\tau_{UP}$ of 1.0 μsec at the fall and the rise of the drive voltage waveform, having a micro vibration period $T_S$ of 2.0 μsec, and having a micro vibration period $T_E$ of 2.0 μsec, the ratio of the displacement amount, corresponding to a potential difference $V_H$-$V_{L1}$ or $V_H$-$V_{L2}$ of the drive voltage $V_P$, of the piezoelectric deformation region 8 at the time of micro vibration with respect to the displacement amount of the piezoelectric deformation region 8 at the time when ON/OFF control of the drive voltage $V_P$ is carried out between $V_H$ and 0V being 20% when it is expressed in percentage.

(Drive Voltage B)

The drive voltage B is a drive voltage having a drive voltage waveform shown in FIG. 7, and having a voltage value $V_H$ of 15V in a waiting time period, having a pulse width $T_2$ of 6.2 μsec, and having time constants $\tau_{DN}$ and $\tau_{UP}$ of 1.0 μsec at the rise and the fall of the drive voltage waveform.

It was confirmed from FIGS. 14 to 17 that when the liquid discharge device 1 was driven by applying the drive voltage having the drive voltage waveform shown in FIG. 8 using the driving method according to the present invention, it was possible to inhibit separation of an ink drop and discharge of an unnecessary ink drop with low velocity or mist, which are caused by residual vibration of the piezoelectric actuator 7, by minimizing the amplitude of the residual vibration as compared with a case where the liquid discharge device was driven by applying a drive voltage having a conventional drive voltage waveform shown in FIG. 7, which could prevent the image quality of a formed image from being degraded due to formation of an extra dot called a satellite.

«Example 2»

The liquid discharge device that was used in the example 1 was driven to discharge ink drops from a nozzle 3 by applying to any one of piezoelectric deformation regions 8 in a piezoelectric actuator 7 from a drive circuit 13 a drive voltage having a drive voltage waveform shown in FIG. 8 and being the same as the above-mentioned drive voltage A except that the ratio of the displacement amount, corresponding to a potential difference $V_H$-$V_{L1}$ or $V_H$-$V_{L2}$ of the drive voltage $V_P$, of the piezoelectric deformation region 8 at the time of micro vibration with respect to the displacement amount of the piezoelectric deformation region 8 at the time when ON/OFF control of the drive voltage $V_P$ is carried out between $V_H$ and 0V was set to values shown in Table 1 when it was expressed in percentage. Then, a performance for discharging an ink drop was evaluated based on the following criteria by observing a discharged ink drop and a formed image which was formed by the ink drop.

Significantly good: no unnecessary ink drop with low velocity, mist and the like were observed in the ink drop discharged from the nozzle, and no satellite was also observed in the formed image.

Good: satellites were slightly observed in the formed image, but no unnecessary ink drop with low velocity, mist and the like were observed in the ink drop discharged from the nozzle.

Practical level: an unnecessary ink drop with low velocity, mist and the like were observed in the ink drop discharged from the nozzle, and satellites were observed in the formed image, but the performance was at a practical level.

Bad: an unnecessary ink drop with low velocity, mist and the like were observed in the ink drop discharged from the nozzle, and a large number of satellites were observed in the formed image.

The results are shown in Table 1.

TABLE 1

| Displacement amount (%) | Evaluation |
|---|---|
| 5 | Significantly good |
| 10 | Significantly good |
| 20 | Significantly good |
| 30 | Significantly good |
| 40 | Significantly good |
| 50 | Good |
| 60 | Practical level |

Table shows that it is preferable that the ratio of the displacement amount, corresponding to a potential difference $V_H$-$V_{L1}$ or $V_H$-$V_{L2}$ of the drive voltage $V_P$, of the piezoelectric deformation region 8 at the time of micro vibration with respect to the displacement amount of the piezoelectric deformation region 8 at the time when ON/OFF control of the drive voltage $V_P$ was carried out between $V_H$ and 0V is 5 to 50% and particularly 5 to 40% when it is expressed in percentage.

The invention claimed is:

1. A liquid discharge device, comprising:

(A) a pressure chamber to be filled with a liquid;

(B) a nozzle communicating with the pressure chamber;

(C) a piezoelectric actuator vibrated by application of a drive voltage and ON/OFF control of the drive voltage for discharging the liquid within the pressure chamber through the nozzle as a liquid drop;

(D) a drive circuit for applying the drive voltage to the piezoelectric actuator; and (E) a control unit for carrying out the ON/OFF control of the drive voltage, wherein the control unit carries out discharge movement which turns the drive voltage off from a waiting state in which the drive voltage is on, and then turns the drive voltage on again to vibrate the piezoelectric actuator, thereby to discharge the liquid within the pressure chamber as the liquid drop through the nozzle, and the control unit includes a micro vibration control section for controlling the driving of the drive circuit periodically repeats fall and rise of the drive voltage in a range, in which the drive voltage is not turned off and having a cycle shorter than a discharging cycle of liquid drop, immediately after the drive voltage is turned on again as part of the discharge movement for every discharge movement, in order to micro-vibrate the piezoelectric actuator in a range in which no liquid drop is discharged from the nozzle.

2. The liquid discharge device according to claim 1, wherein the micro vibration control section repeats an operation of lowering the drive voltage, and raising the drive voltage in a range in which the drive voltage is not turned off while falling, thereby to micro-vibrate the piezoelectric actuator, on the basis of a time constant of voltage fall at the time when the drive voltage is turned off and a time constant of voltage rise at the time when the drive voltage is turned on, which are previously set in the drive circuit, in order to carry out ON/OFF control of the drive voltage to discharge the liquid drop.

3. The liquid discharge device according to claim 1, wherein the micro vibration control section micro-vibrates the piezoelectric actuator by a displacement amount that is 5 to 50% of the displacement amount of the piezoelectric actuator when the ON/OFF control of the drive voltage is carried out to discharge the liquid drop.

4. A piezoelectric ink jet head, comprising the liquid discharge device according to claim 1, and incorporated into an ink jet printer and used for discharging an ink drop as a liquid drop from the nozzle to make a drawing.

5. A liquid discharge device, comprising:

(A) a pressure chamber to be filled with a liquid;

(B) a nozzle communicating with the pressure chamber, (C) a piezoelectric actuator vibrated by application of a drive voltage and ON/OFF control of the drive voltage for discharging the liquid within the pressure chamber through the nozzle as a liquid drop;

(D) a drive circuit for applying the drive voltage to the piezoelectric actuator; and (E) a control unit for carrying out the ON/OFF control of the drive voltage, wherein the control unit carries out discharge movement which turns the drive voltage off from a waiting state in which the drive voltage is on, and then turns the drive voltage on again to vibrate the piezoelectric actuator, thereby to discharge the liquid within the pressure chamber as the liquid drop through the nozzle, and the control unit includes a micro vibration control section for controlling the driving of the drive circuit periodically repeats fall and rise of the drive voltage in a range, in which the drive voltage is not turned off and having a cycle shorter than a discharging cycle of liquid drop, immediately before the drive voltage is turned off as part of the discharge movement for every discharge movement, to micro-vibrate the piezoelectric actuator in a range in which no liquid drop is discharged from the nozzle.

6. The liquid discharge device according to claim 5, wherein the micro vibration control section repeats an operation of lowering the drive voltage, and raising the drive voltage in a range in which the drive voltage is not turned off while falling, thereby to micro-vibrate the piezoelectric actuator, on the basis of a time constant of voltage fall at the time when the drive voltage is turned off and a time constant of voltage rise at the time when the drive voltage is turned on, which are previously set in the drive circuit, in order to carry out ON/OFF control of the drive voltage to discharge the liquid drop.

7. The liquid discharge device according to claim 5, wherein the micro vibration control section micro-vibrates the piezoelectric actuator by a displacement amount that is 5 to 50% of the displacement amount of the piezoelectric actuator when the ON/OFF control of the drive voltage is carried out to discharge the liquid drop.

8. A piezoelectric ink jet head, comprising the liquid discharge device according to claim 5, and incorporated into an ink jet printer and used for discharging an ink drop as a liquid drop from the nozzle to make a drawing.

9. A driving method for a liquid discharge device comprising (a) a pressure chamber to be filled with a liquid, (b) a nozzle communicating with the pressure chamber, and (c) a piezoelectric actuator vibrated by application of a drive voltage and ON/OFF control of the drive voltage for discharging the liquid within the pressure chamber through the nozzle as a liquid drop, the method comprising the steps of:

a discharging signal of turning the drive voltage off from a waiting state in which the drive voltage is on, and then turning the drive voltage on again to vibrate the piezoelectric actuator, thereby to discharge the liquid within the pressure chamber as the liquid drop through the nozzle; and a micro-vibrating signal of periodically repeating fall and rise of the drive voltage in a range, in which the drive voltage is not turned off and having a cycle shorter than the above-mentioned signal, immediately after the drive voltage is turned on again as part of the discharging signal, thereby to micro-vibrate the piezoelectric actuator in a range in which no liquid drop is discharged from the nozzle;

are inputted as one set, and the piezoelectric actuator is made to drive.

10. The driving method for a liquid discharge device according to claim 9, comprising the steps of:

repeating an operation of lowering the drive voltage, and raising the drive voltage in a range in which the drive voltage is not turned off while falling, thereby to micro-vibrate the piezoelectric actuator, on the basis of a time constant of voltage fall at the time when the drive voltage is turned off and a time constant of voltage rise at the time when the drive voltage is turned on, which are previously set in the drive circuit for applying the drive voltage to the piezoelectric actuator, in order to carry out ON/OFF control of the drive voltage to discharge the liquid drop.

11. The driving method for a liquid discharge device according to claim 9, comprising the step of micro-vibrating the piezoelectric actuator by a displacement amount that is 5 to 50% of the displacement amount of the piezoelectric actuator when ON/OFF control of the drive voltage is carried out to discharge the liquid drop.

12. A driving method for a liquid discharge device comprising, (a) a pressure chamber to be filled with a liquid, (b) a nozzle communicating with the pressure chamber, and (c) a piezoelectric actuator vibrated by application of a drive voltage and ON/OFF control of the drive voltage for discharging the liquid within the pressure chamber through the nozzle as a liquid drop, the method comprising the steps of:

a discharging signal of turning the drive voltage off from a waiting state in which the drive voltage is on, and then turning the drive voltage on again to vibrate the piezoelectric actuator, thereby to discharge the liquid within the pressure chamber as the liquid drop through the nozzle; and a micro-vibrating signal of periodically repeating fall and rise of the drive voltage in a range, in which the drive voltage is not turned off and having a cycle shorter than the above-mentioned signal, immediately before the drive voltage is turned off as part of the discharging signal, thereby to micro-vibrate the piezoelectric actuator in a range in which no liquid drop is discharged from the nozzle;

are inputted as one set, and the piezoelectric actuator is made to drive.

13. The driving method for a liquid discharge device according to claim 12, comprising the steps of:

repeating an operation of lowering the drive voltage, and raising the drive voltage in a range in which the drive voltage is not turned off while falling, thereby to micro-vibrate the piezoelectric actuator, on the basis of a time constant of voltage fall at the time when the drive voltage is turned off and a time constant of voltage rise at the time when the drive voltage is turned on, which are previously set in the drive circuit for applying the drive voltage to the piezoelectric actuator, in order to carry out ON/OFF control of the drive voltage to discharge the liquid drop.

14. The driving method for a liquid discharge device according to claim 12, comprising the step of micro-vibrating the piezoelectric actuator by a displacement amount that is 5 to 50% of the displacement amount of the piezoelectric actuator when ON/OFF control of the drive voltage is carried out to discharge the liquid drop.

* * * * *